US010239334B2

(12) United States Patent
Torigoe

(10) Patent No.: US 10,239,334 B2
(45) Date of Patent: Mar. 26, 2019

(54) PRINTING APPARATUS AND CONVEYING APPARATUS

(71) Applicant: SEIKO EPSON CORPORATION, Tokyo (JP)

(72) Inventor: Yasuhide Torigoe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/601,368

(22) Filed: May 22, 2017

(65) Prior Publication Data

US 2017/0334224 A1 Nov. 23, 2017

(30) Foreign Application Priority Data

May 23, 2016 (JP) ..... 2016-102170

(51) Int. Cl.
*B41J 2/01* (2006.01)
*B41J 15/04* (2006.01)
(Continued)

(52) U.S. Cl.
CPC ..... *B41J 15/04* (2013.01); *B41J 17/32* (2013.01); *B65H 19/126* (2013.01); *B65H 19/30* (2013.01);
(Continued)

(58) Field of Classification Search
CPC . B41J 15/04; B41J 15/02; B41J 15/042; B41J 11/001; B41J 11/0025; B41J 11/003;
(Continued)

(56) References Cited

U.S. PATENT DOCUMENTS 7,690,473 B2 * 4/2010 Hammonds ..... B62D 33/063 180/326
2009/0104007 A1 * 4/2009 Umezawa ..... B66F 9/063 414/349
2012/0205418 A1 * 8/2012 Horie ..... B41J 11/001 226/168

FOREIGN PATENT DOCUMENTS

CN 204369214 U * 6/2015
JP 09-150996 A 6/1997
(Continued)

OTHER PUBLICATIONS

English language machine translation of detailed description of JP2012-076835, publication date Apr. 19, 2017.*
(Continued)

*Primary Examiner* — Leslie J Evanisko
(74) *Attorney, Agent, or Firm* — Workman Nydegger

(57) ABSTRACT

A printing apparatus and a conveying apparatus are provided. The printing apparatus is provided with a main body unit including a printing unit configured to print on a medium and legs supporting the printing unit. The printing apparatus includes a pair of holding members configured to hold both ends, in an axial direction, of a roll of media at a position vertically above a floor surface on which the main body unit is placed. The roll of media is formed by winding the medium. A drive unit is configured to rotate the roll of media held by the holding members. A guide member connected to the main body unit is configured to support the holding members moveably in a width direction X. The guide member is disposed at a position horizontally closer to the main body unit than the holding members.

5 Claims, 7 Drawing Sheets

(51) Int. Cl.
*B65H 19/12* (2006.01)
*B41J 17/32* (2006.01)
*B65H 19/30* (2006.01)

(52) U.S. Cl.
CPC ..... *B41J 2/01* (2013.01); *B65H 19/12* (2013.01); *B65H 2801/12* (2013.01)

(58) Field of Classification Search
CPC ..... B65H 16/02; B65H 18/10; B65H 18/14; B65H 19/12; B65H 19/126; B65H 19/30; B65H 67/02; B65H 67/06; B65H 2301/36112
USPC ..... 101/479, 480; 400/611, 613; 347/104; 242/592, 598.3, 598.5; 414/460, 745.3, 414/745.9
See application file for complete search history.

(56) References Cited

FOREIGN PATENT DOCUMENTS

| | | | | |
|---|---|---|---|---|
| JP | 2009196761 | A | * | 9/2009 |
| JP | 2012076835 | A | * | 4/2012 |
| JP | 2012166915 | A | * | 9/2012 |
| JP | 2015-129030 | A | | 7/2015 |

OTHER PUBLICATIONS

English language machine translation of detailed description of JP2012-166915, publication date Sep. 6, 2012.*
Epson Stylus Pro GS6000 Setup and Use Guide, Copyright 2008 Epson America, Inc. Jul. 2008.

* cited by examiner

PRINTING APPARATUS AND CONVEYING APPARATUS

BACKGROUND

1. Technical Field

Embodiments of the present invention relate to a printing apparatus, such as an ink jet printer or the like, for printing on a medium. Embodiments of the invention further relate to a conveying apparatus for conveying a roll of media, formed by winding a medium, to the printing apparatus.

2. Related Art

In the related art, printing apparatuses that are provided with a pair of holding members (a pair of roll holders) that detachably hold a roll of media, formed by winding a medium are known. These printing apparatuses may also have a guide portion (guide member) that supports the pair of holding members such that the pair of holding members are capable of movement in an axial direction of the roll of media and a printing unit that prints on the medium that is unwound from the roll of media held by the pair of holding members.

Among such printing apparatuses, there are also printing apparatuses in which a mount (a media mount), on which the roll of media can be mounted, is provided on the guide member (e.g. JP-A-2015-129030). With such printing apparatuses, the roll of media is held by the pair of holding members. To cause the roll of media to be held by the pair of holding members, the user of the printing apparatus temporarily mounts the roll of media conveyed to the printing apparatus on the mount of the printing apparatus, adjusts the height of the roll of media temporarily mounted on the mount, and secures both ends in the axial direction of the roll of media to the pair of holding members.

However, with printing apparatuses such as that described above, the user of the printing apparatus is required to carry out a plurality of steps as described above in order to cause the pair of holding members to hold the roll of media. In other words, in order to install the roll of media on the printing apparatus, the user is required to perform multiple steps. As such, there is room for improvement with regards to reducing the burden placed on the user.

Embodiments of the invention are advantageous in that a printing apparatus and a conveying apparatus are provided whereby the burden placed on a user when installing a roll of media on the printing apparatus can be reduced.

SUMMARY

Hereinafter, a description is given of the means for solving the problem and examples of the advantages of the invention.

A printing apparatus according to a first aspect of the invention includes a main body unit that includes a printing unit configured to print on a medium and legs supporting the printing unit. The printing apparatus may also include a pair of holding members configured to hold both ends in an axial direction of a roll of media at a position vertically above a floor surface on which the main body unit is placed. The roll of media may be formed by winding the medium. The printing apparatus may include a drive unit configured to rotate the roll of media held by the holding members and a guide member that is connected to the main body unit. When the axial direction of the roll of media held by the holding members is a width direction of the guide member, the guide member is configured to support the holding members such that the holding members are capable of movement in the width direction. In such a printing apparatus, the guide member may be disposed at at least one position among a position vertically above the holding members and a position horizontally closer to the main body unit than the holding members.

If the guide member, which supports the holding members such that the holding members are capable of movement in the width direction, is disposed vertically under the holding members, the guide member may interfere with a conveying apparatus when attempting to move the conveying apparatus on which the roll of media is mounted such that the roll of media is positioned in an area between the pair of holding members.

In contrast, according to the first aspect of the invention, the guide member, which supports the holding members such that the holding members are capable of movement in the width direction, may be disposed at a position vertically above the holding members and/or at a position horizontally closer to the main body unit than the holding members. In other words, the guide member, which supports the holding members such that the holding members are capable of movement in the width direction, is not disposed in the space below the pair of holding members and the area between the pair of holding members. As such, the conveying apparatus on which the roll of media is mounted can be moved such that the roll of media is positioned in the area between the pair of holding members, while preventing interference between the guide member and the conveying apparatus. Thus, the guide member does not interfere with the conveying apparatus.

Accordingly, the conveying apparatus on which the roll of media is mounted can be moved such that the roll of media is positioned in the area between the pair of holding members and, thereafter, the holding members can be caused to hold the roll of media without the need to reposition the roll of media. Thus, the burden placed on the user when installing the roll of media on the printing apparatus can be reduced by an amount corresponding to the eliminated temporarily mounting the roll of media on the printing apparatus.

The main body unit may include an introduction member on a back side of the main body unit. The introduction member may be configured to guide the medium to the printing unit. The holding members may be disposed on the main body unit via the guide member and may protrude backwards from the main body unit, vertically below the introduction member.

In this case, the introduction member that introduces the medium and the holding members that hold the roll of media are both provided on the back side of (behind) the main body unit. As such, the path on which the medium is guided from the holding members to the introduction member is prevented from becoming complicated.

The printing apparatus according to the first aspect may also include a conveying apparatus including a mount on which the roll of media is mounted and an adjustment member configured to adjust a vertical position of the mount. In this case, the conveying apparatus is configured to convey the roll of media while the roll of media is mounted on the mount.

In this case, the roll of media can be conveyed while mounted on the mount of the conveying apparatus. Additionally, in cases where causing the holding members to hold the roll of media, the height of the roll of media mounted on the mount can be adjusted so as to match the height at which the holding members can hold the roll of media. Accordingly, the holding members can easily be caused to engage with and hold the roll of media.

It is preferable that, when the roll of media with a shortest length in the width direction is a smallest roll of media, the mount of the conveying apparatus is shorter in the width direction than the smallest roll of media. In other words, the mount of the conveying apparatus is sized to be shorter in the width direction that the smallest roll of media to be mounted on the printing apparatus.

If the mount of the conveying apparatus is longer in the width direction than the smallest roll of media, the holding members may interfere with the mount when moving the holding members inward in the width direction in order to cause the holding members of the printing apparatus to hold the roll of media (e.g. the smallest roll of media). Consequently, there is a risk that it may not be possible to move the holding members to positions at which the roll of media can be held. However, in this case, the mount of the conveying apparatus is shorter in the width direction than the smallest roll of media. As such, interference of the holding members with the mount can be prevented when moving the holding members inward in the width direction in order to cause the holding members of the printing apparatus to hold the smallest roll of media. That is, regardless of the length in the width direction of the roll of media, it is easier to cause the holding members to hold the roll of media conveyed by the conveying apparatus.

A conveying apparatus according to a second aspect of the invention includes a mount on which a roll of media is mounted and an adjustment member configured to adjust a vertical position of the mount. In such a conveying apparatus, the roll of media is formed by winding a medium, and the conveying apparatus is configured to convey the roll of media to a printing apparatus on which the roll of media is to be mounted and which is configured to print on the medium unwound from the roll of media.

In this case, the conveying apparatus that conveys the roll of media is provided with the adjustment member that adjusts the vertical position of the mount on which the roll of media is mounted. As such, the height of the roll of media can easily be adjusted to the height at which the roll of media is to be held in the printing apparatus. Accordingly, the burden placed on the user when installing the roll of media on the printing apparatus can be reduced.

BRIEF DESCRIPTION OF THE DRAWINGS

Embodiments of the invention will be described with reference to the accompanying drawings, wherein like numbers reference like elements.

DESCRIPTION OF EMBODIMENTS

An exemplary embodiment of a printing apparatus is described below while referencing the accompanying drawings. Note that the printing apparatus of the present exemplary embodiment is an ink jet printer that prints characters and images by discharging ink on a medium such as a sheet. Embodiments of the invention are not limited to ink jet printers.

Figure 1:
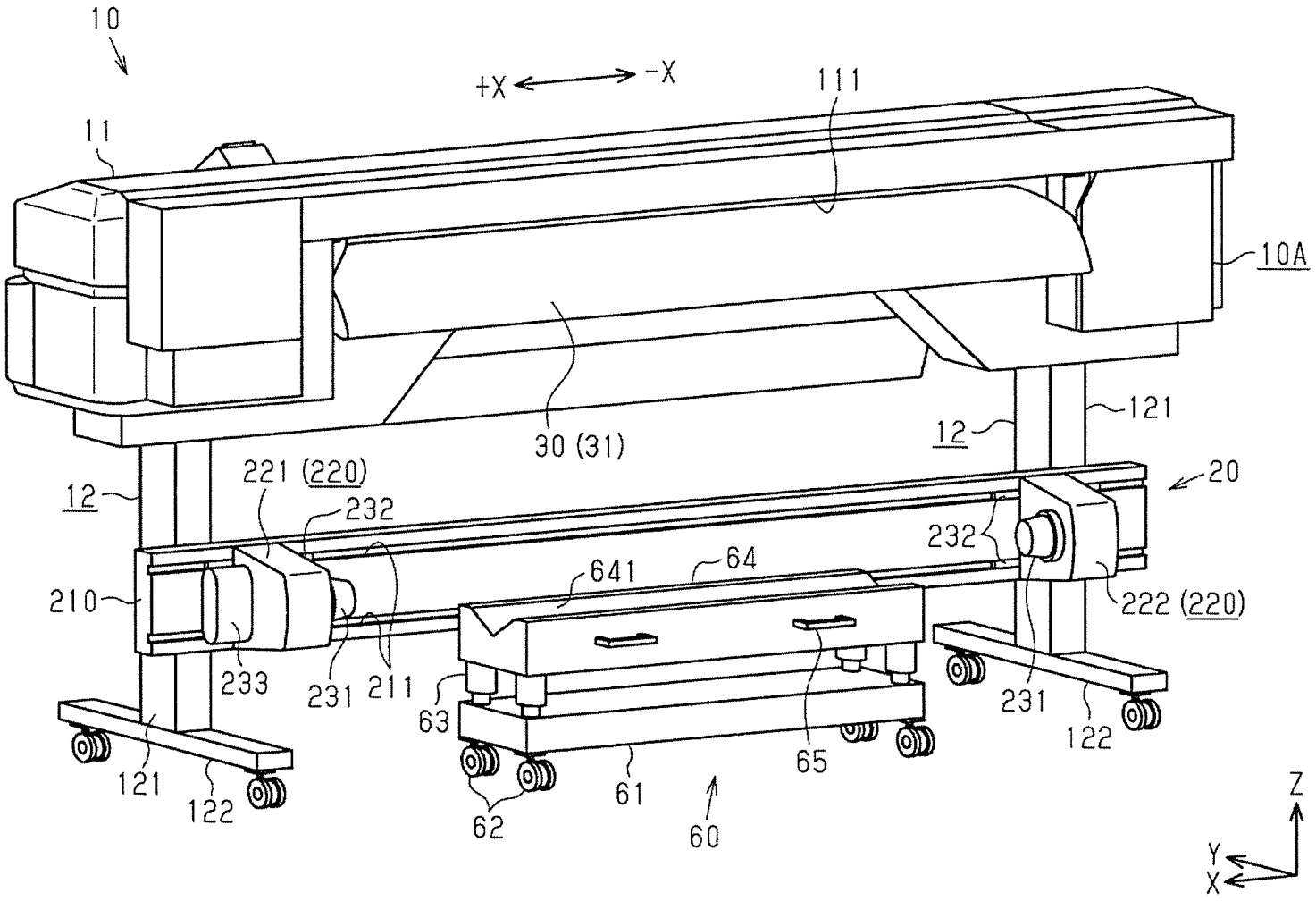
FIG. 1 is a perspective view of a back side of a printing apparatus according to an exemplary embodiment of the invention.
Figure 2:
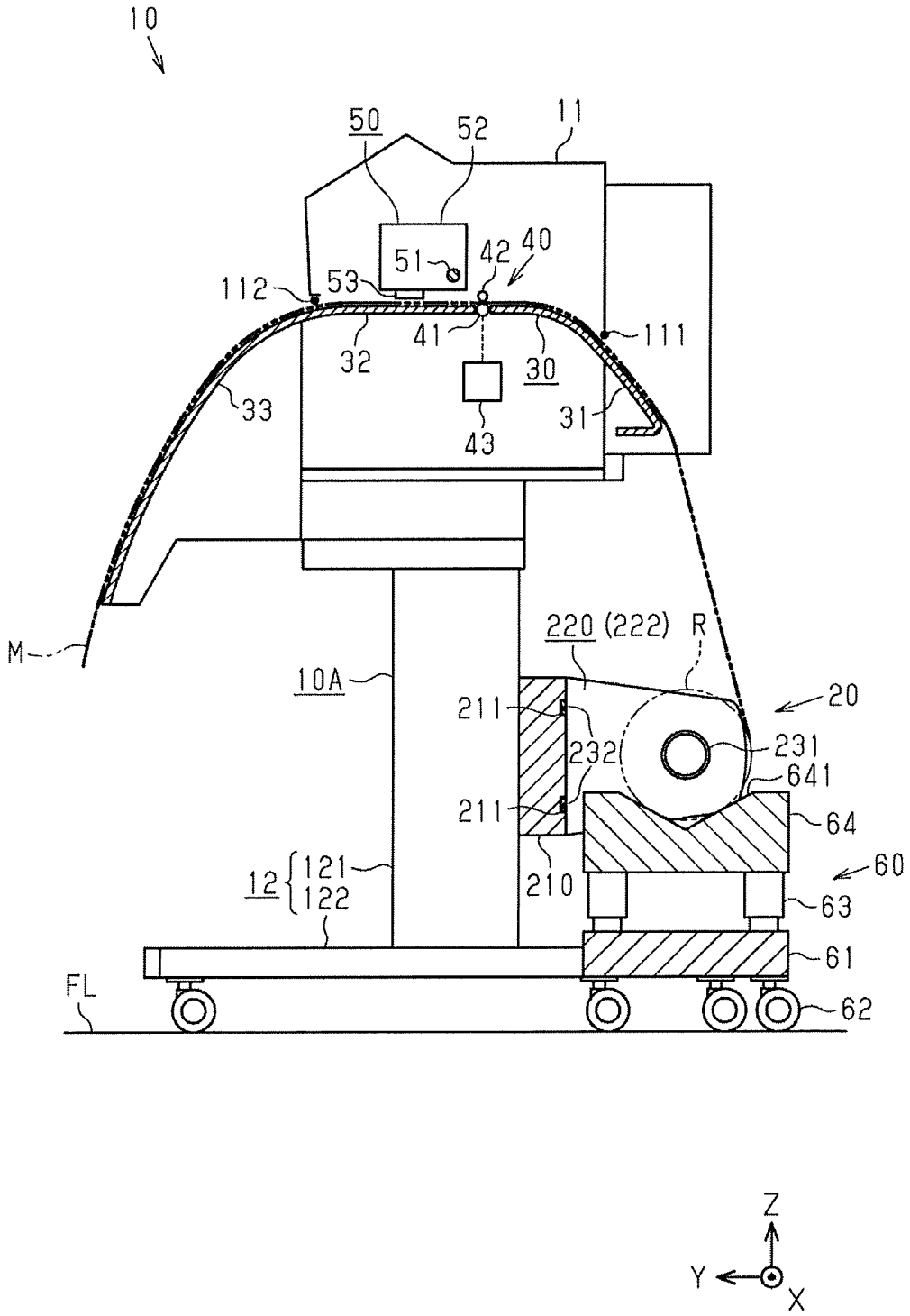
FIG. 2 is a side view of the printing apparatus.

As illustrated in FIG. 1 and FIG. 2, a printing apparatus 10 is provided with a housing 11 that houses constituents related to printing, and legs 12 that support the housing 11. Additionally, the printing apparatus 10 is provided with a supply unit 20 that serves as a supply source of a medium M, a support unit 30 that guides the medium M, a transport unit 40 that transports the medium M, a printing unit 50 that prints on the medium M, and a conveying apparatus 60 that conveys a roll of media R formed by winding the medium M. Note that in the exemplary embodiment, a configuration of the printing apparatus 10 without the supply unit 20 and the conveying apparatus 60 is referred to as a "main body unit 10A". That is, the main body unit 10A includes at least the printing unit 50 that prints on the medium M and the legs 12 that support the printing unit 50 via the housing 11.

In the following description, a width direction of the printing apparatus 10, which is also a longitudinal direction of the housing 11, is referred to as a "width direction X". A front-back direction of the printing apparatus 10 is referred to as a "horizontal direction Y". A vertical direction, which is also a direction perpendicular to a floor surface FL, is referred to as a "vertical direction Z". The width direction X, the horizontal direction Y, and the vertical direction Z are directions that cross (are orthogonal to) each other. Additionally, in the exemplary embodiment, a first end in the width direction X is referred to as a "first end +X", and a second end in the width direction X is referred to as a "second end −X".

As illustrated in FIG. 1 and FIG. 2, the housing 11 has a substantially rectangular parallelepiped shape for which the width direction X is the longitudinal direction. An introduction port 111 through which the medium M is introduced into the housing 11 is open on the back side of the housing 11, and a discharge port 112 through which the medium M is discharged out of the housing 11 is open on the front side of the housing 11. That is, in the exemplary embodiment, the introduction port 111 corresponds to an example of the introduction member configured to guide the medium M to the printing unit 50 (into the housing 11).

As illustrated in FIG. 1, the legs 12 are provided as a pair in the width direction X. The legs 12 include a first leg portion 121 for which the vertical direction Z is the longitudinal direction, and a second leg portion 122 for which the horizontal direction Y is the longitudinal direction. A lower end portion of the first leg portion 121 is connected to a center portion in the longitudinal direction of the second leg portion 122, and an upper end portion of the first leg portion 121 is connected to a lower portion of the housing 11.

As illustrated in FIG. 2, the support unit 30 is provided with, from upstream toward downstream in the transport direction, a first support member 31, a second support member 32, and a third support member 33. These constituents form the transport path of the medium M. The first support member 31 guides the medium M fed from the supply unit 20 toward the second support member 32, the second support member 32 supports the medium M on which printing is to be performed, and the third support member 33 guides the medium M on which printing has been performed downstream in the transport direction. Note that the transport direction is a direction in which the medium M is transported from the supply unit 20 toward the printing unit 50.

The transport unit 40 is provided with a transport roller 41 that imparts a transporting force to the medium M, a driven roller 42 that presses the medium M toward the transport roller 41, and a transport motor 43 that drives the transport roller 41. The transport roller 41 and the driven roller 42 have the width direction X as axial directions. Additionally, the transport roller 41 is disposed vertically below the transport path of the medium M, and the driven roller 42 is disposed vertically above the transport path of the medium M. Moreover, the transport unit 40 transports the medium M in the transport direction by driving the transport motor 43 while the medium M is sandwiched by the transport roller 41 and the driven roller 42.

The printing unit 50 is provided with a guide shaft 51 having the width direction X as an axial direction, a carriage 52 supported on the guide shaft 51, and a discharge unit 53 that discharges ink onto the medium M. The carriage 52 has a substantially box shape and supports the discharge unit 53 such that the discharging of ink from the discharge unit 53 is directed toward the second support member 32. Additionally, the discharge unit 53 is a so-called ink jet head and discharges ink such as, for example, cyan ink, magenta ink, yellow ink, black ink, or the like.

Next, a description of the supply unit 20 will be given while referencing FIG. 1 to FIG. 3.

Figure 3:
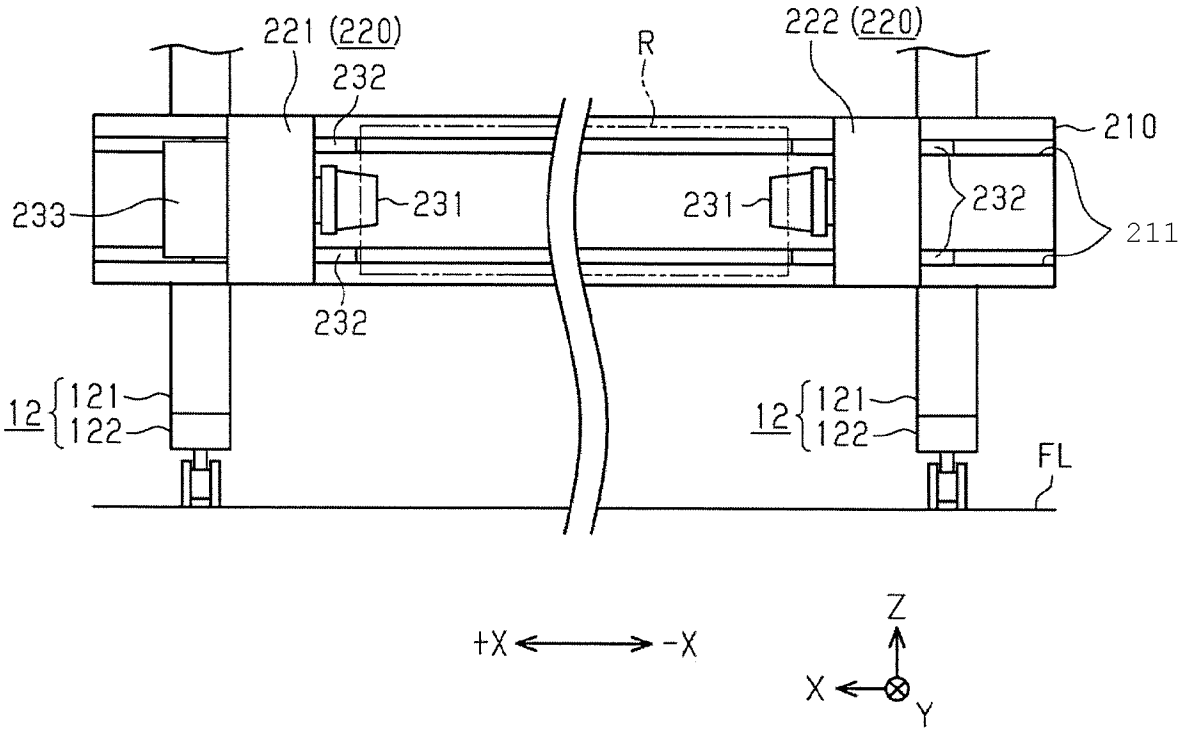
FIG. 3 is a partial back view of the printing apparatus.

As illustrated in FIG. 1 to FIG. 3, the supply unit 20 includes a guide member 210 connected to the legs 12, and a pair of holding members 220 supported on the guide member 210.

As illustrated in FIG. 1 and FIG. 3, the guide member 210 has a flat shape, and a length in the longitudinal direction thereof is longer than a distance in the width direction X between the legs 12. Additionally, sliding grooves 211 that slidably support the pair of holding members 220 are formed in the guide member 210, along the longitudinal direction thereof. Moreover, the guide member 210 is connected to the main body unit 10A (the first leg portion 121) in a state where the surface of the guide member 210 in which the sliding grooves 211 are formed is facing backward or away from the main body unit 10A or from the leg portion 121. Note that bolts or similar fastening members may be used when connecting the guide member 210 to the legs 12.

As illustrated in FIG. 1 and FIG. 3, the pair of holding members 220 includes a first holding member 221 supported at the first end +X side in the width direction X on the guide member 210. The first holding member 221 holds a first end portion in the axial direction of the roll of media R. The pair of holding members 220 also includes a second holding member 222 supported at the second end −X side in the width direction X on the guide member 210. The second holding member 222 holds a second end portion in the axial direction of the roll of media R. The first holding member 221 and the second holding member 222 are supported on the guide member 210 at positions vertically above the floor surface FL on which the main body unit 10A (the printing apparatus 10) is placed.

As illustrated in FIG. 3, the first holding member 221 includes a rotational member 231 that rotates while engaged with the first end portion in the axial direction of the roll of media R, sliding members 232 that slide in the sliding grooves 211 of the guide member 210, and a drive unit 233 that rotationally drives the rotational member 231. On the other hand, the second holding member 222 includes a rotational member 231 that rotates while engaged with the second end portion in the axial direction of the roll of media R, and sliding members 232 that slide in the sliding grooves 211 of the guide member 210. The drive unit 233 may only be provided or associated with one of the holding members 220.

As illustrated in FIG. 3, the rotational members 231 have a tapered shape that tapers off from a base toward a tip thereof. Additionally, in a state where the holding members 220 are supported on the guide member 210, tips of the rotational members 231 face toward the center in the width direction. Moreover, the rotational members 231 are configured to engage with the end portions of the roll of media R by being inserted into end portions of a cylindrical core member of the roll of media R.

The sliding members 232 have a shape that corresponds to the sliding grooves 211 of the guide member 210. The sliding members 232 engage with the sliding grooves 211 and, as a result, allow movement in the width direction X, but restrict movement in the horizontal direction Y and the vertical direction Z. Thus, movement of the holding members 220 in the width direction X is guided by the guide member 210 while movement in the Y and Z directions is prevented or restricted. Additionally, the drive unit 233 of the first holding member 221 is constituted by a motor and a reduction gear, for example. The roll of media R engaged with the rotational members 231, that is, the roll of media R held by the holding members 220, is rotated by rotating the rotational member 231 of the first holding member 221.

Thus, as illustrated in FIG. 1 and FIG. 2, in the exemplary embodiment, the supply unit 20 is supported on the main body unit 10A (the first leg portion 121), and protrudes backward from the legs 12. That is, the holding members 220 are disposed protruding backward from the main body unit 10A (the first leg portion 121) via the guide member 210. The guide member 210 is positioned between the leg portion 121 and the holding members 220.

As such, the guide member 210 is disposed at a position horizontally closer to the main body unit 10A than the holding members 220 (a position on the front side of the main body unit 10A). That is, in the exemplary embodiment, the first leg portion 121, the guide member 210, and the holding members 220 are disposed in this order from the front side toward the back side of the printing apparatus 10. Accordingly, in the exemplary embodiment, the configuration that supports the pair of holding members 220 such that the holding members 220 are capable of movement in the width direction X does not exist vertically below the pair of holding members 220 and the area between the pair of holding members 220. In other words, the pair of holding members 220 are supported such that an area vertically beneath the holding members and between the holding members is clear of any supporting structure. As a result, the configuration or structure supporting the pair of holding members does not interfere with the process of mounting a roll of media.

Due to the fact that the holding members 220 are capable of movement in the width direction X, the supply unit 20 can hold rolls of media R with different lengths in the width direction X. Here, of the rolls of media R that the supply unit 20 can hold, the roll of media R with the shortest length in the width direction X is referred to as a "smallest roll of media Rm". The smallest roll of media Rm may be different with respect to different printing apparatuses.

The medium M unwound from the roll of media R can be supplied toward the printing unit 50 by rotating the rotational member 231 of the first holding member 221 by driving the drive unit 233 while the roll of media R is held by the pair of holding members 220 in the supply unit 20. Note that when rotating the roll of media R held by the holding members 220, the second holding member 222 that does not include the drive unit 233 is driven to rotate by the rotation of the roll of media R. As the roll of media R unwinds, the media can be fed into the printing apparatus and the media can be printed on by the printing unit.

Figure 4:
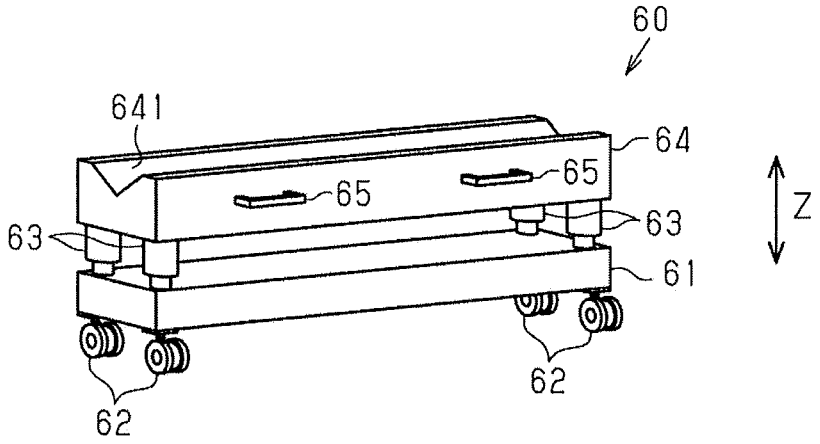
FIG. 4 is a perspective view of a conveying apparatus according to an exemplary embodiment of the invention.
Figure 5:
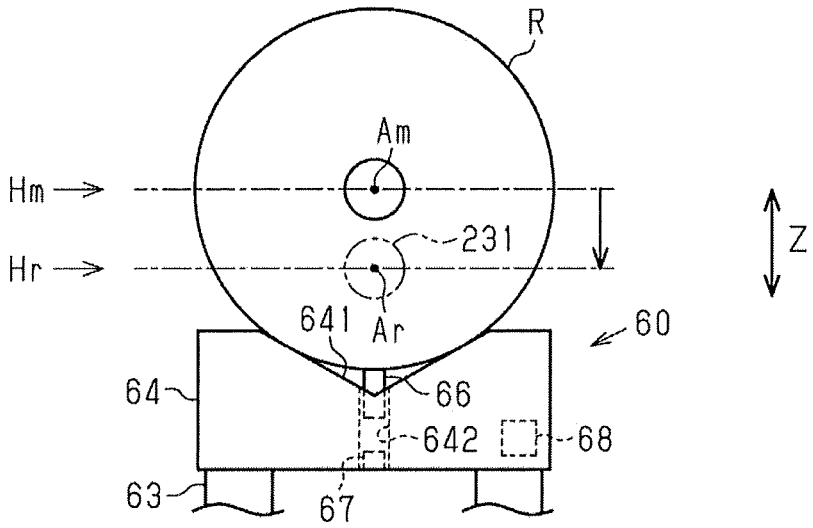
FIG. 5 is a side view of the conveying apparatus in a state where a roll of media with a large remaining amount is mounted.
Figure 6:
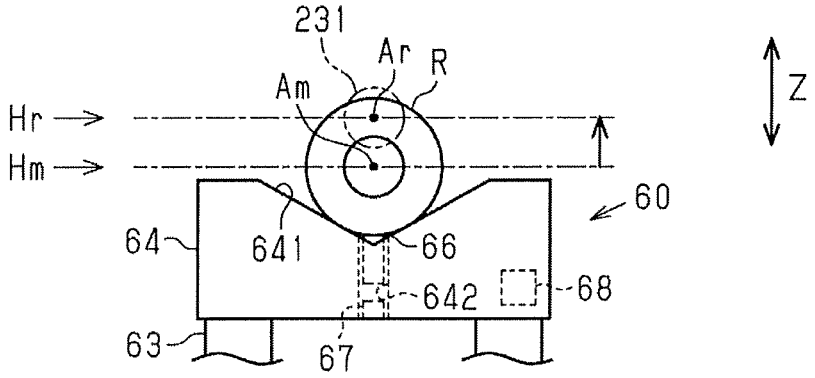
FIG. 6 is a side view of the conveying apparatus in a state where a roll of media with a small remaining amount is mounted.

Next, a description of the conveying apparatus 60 is given while referencing FIG. 4 to FIG. 6. The conveying apparatus 60 may be a dolly that conveys the roll of media R while the roll of media R is mounted thereon. Additionally, FIG. 5 and FIG. 6 virtually illustrate the rotational member 231 of the holding members 220 of the supply unit 20 in order to explain a height relationship between the supply unit 20 and the roll of media R mounted on a mount 64 of the conveying apparatus.

As illustrated in FIG. 4, the conveying apparatus 60 is provided with a base 61, a plurality of wheels 62 that are provided vertically below the base 61, a plurality of telescopic mechanisms 63 extending vertically upward from the base 61, a mount 64 supported by the telescopic mechanisms 63, and grips 65 protruding sideways or laterally from the mount 64. Additionally, as illustrated in FIG. 5, the conveying apparatus 60 is provided with a displacement member 66 displaced by the roll of media R that is mounted on the mount 64, a detection unit 67 that detects a position of the displacement member 66, and a control unit 68 that controls the telescopic mechanisms 63 on the basis of detection results of the detection unit 67.

As illustrated in FIG. 4, the base 61 has a substantially rectangular parallelepiped shape, the wheels 62 are attached at the four corners of a bottom surface of the base 61, and the telescopic mechanisms 63 are erected vertically upward at the four corners of a top surface of the base 61. The telescopic mechanisms 63 are, for example, mechanisms that telescope using fluid as an energy transfer medium, such as hydraulics or the like, and specifically may be configured from hydraulic cylinders and hydraulic pumps. Additionally, the grips 65 are handles that are gripped when the user of the printing apparatus 10 pushes or pulls when moving the conveying apparatus 60.

The mount 64 has a substantially rectangular parallelepiped shape, and includes a bearing portion 641 sloping vertically downward toward the center in the transverse direction of the mount 64. The bearing portion 641 is formed in the mount 64 throughout the longitudinal direction of the mount 64. When the roll of media R is mounted on the mount 64, the roll of media R fits in the bearing portion 641 such that the axial direction of the roll of media R matches the longitudinal direction of the mount 64 and, as a result, the posture of the roll of media R is stabilized. Moreover, a length in the longitudinal direction of the mount 64 is shorter than the length in the axial direction of the smallest roll of media. In one example, the mount 64 may form a concave portion in which the roll of media may be placed. The mount 64 may be shaped to prevent the roll of media from rolling off of the conveying apparatus 60.

As illustrated in FIG. 5, a through hole 642 penetrating in the vertical direction Z is formed in a center portion in the horizontal direction of the mount 64. The displacement member 66 is inserted into a vertical top portion of the through hole, in a state where the vertical top portion of the displacement member 66 is exposed. The detection unit 67 is disposed in a vertical bottom portion of the through hole 642. The displacement member 66 is biased vertically upward within the through hole 642, and is displaced vertically downward within the through hole 642 when a load is applied vertically downward thereon. Thus, the displacement member 66 may be pushed down when a roll of media is loaded onto the mount 64. Additionally, the detection unit 67 is a sensor for detecting a distance from the detection unit 67 to the bottom end of the displacement member 66 and may be a reflective optical sensor, for example.

The control unit 68 calculates an amount of displacement of the displacement member 66 on the basis of the detection results of the detection unit 67. Specifically, using a case where the roll of media R is not mounted on the mount 64 for reference, the control unit 68 calculates the amount of displacement of the displacement member 66 on the basis of the amount of change in position of the displacement member 66 that occurs as a result of mounting the roll of media R on the mount 64.

There are cases where the roll of media R mounted on the mount 64 of the conveying apparatus 60 has a large outer diameter and there are also cases where the roll of media R mounted on the mount 64 of the conveying apparatus 60 has a small outer diameter. The displacement of the displacement member 66 may be different for different sized rolls or for rolls whose outer diameter differ. Compared to a case such as that illustrated in FIG. 6 where the roll of media R mounted on the mount 64 has a small outer diameter, in a case such as that illustrated in FIG. 5 where the roll of media R mounted on the mount 64 has a large outer diameter, the amount of displacement of the displacement member 66 is small. As a result, the distance from the top surface of the mount 64 to a rotational axis Am of the roll of media R is greater. In other words, the distance from the top surface of the mount 64 to a rotational axis Am of the roll of media R depends on the size of the roll.

In one example, a linear relationship exists between the amount of displacement of the displacement member 66, the outer diameter of the roll of media R, and the distance from the top surface of the mount 64 to the rotational axis Am of the roll of media R. As such, it is possible to estimate the outer diameter of the roll of media R from the amount of displacement of the displacement member 66, estimate the distance from the top surface of the mount 64 to the rotational axis Am of the roll of media R from the amount of displacement of the displacement member 66, and the like.

On the other hand, as illustrated in FIG. 1, in the supply unit 20 of the printing apparatus 10, the guide member 210 is connected to the legs 12 so as to be immovable in the vertical direction Z in one example, and the holding members 220 are supported on the guide member 210 so as to be immovable in the vertical direction Z in one example. As such, when installing the roll of media R in the supply unit 20, a height Hm of the rotational axis Am of the roll of media R mounted on the mount 64 of the conveying apparatus 60 is required to be adjusted to a height Hr of a rotational axis Ar of the rotational members 231 of the holding members 220 of the supply unit 20. In other words, in may be necessary to adjust the position of the roll of media R in order to align the rotational axis Am with the rotational axis Ar when installing the roll of media R.

Note that in the following description, the height Hm of the rotational axis Am of the roll of media R mounted on the mount 64 is referred to simply as the "height Hm of the roll of media R", and the height Hr of the rotational axis Ar of the rotational members 231 of the holding members 220 of the supply unit 20 is referred to simply as the "height Hr of the rotational members 231". Note that the heights Hm and Hr are heights from the floor surface FL in one example.

In the exemplary embodiment, in cases where the roll of media R is mounted on the mount 64, the conveying apparatus 60 (or the control unit 68) is configured to adjust the height of the mount 64 such that the height Hm of the roll of media R is the same as the height Hr of the rotational members 231. On this point, in the exemplary embodiment, an example of "the adjustment member" is configured from the telescopic mechanisms 63 and the control unit 68. Thus, the telescopic mechanisms 63 are an example of the adjustment member.

Next, a description is given of a processing routine executed by the control unit 68 of the conveying apparatus 60 when adjusting the height of the mount 64 in accordance with the roll of media R mounted on the mount 64. Note that the control unit 68 of the conveying apparatus 60 has acquired, in advance, information related to the height Hr of the rotational members 231 of the printing apparatus 10 to which the roll of media R is conveyed.

First, the control unit 68 determines whether or not the roll of media R is mounted on the mount 64 and, in cases where the roll of media R is mounted on the mount 64, causes the detection unit 67 to detect the position of the displacement member 66. Next, the control unit 68 calculates the amount of displacement of the displacement member 66 on the basis of the detection results of the detection unit 67, and calculates the height Hm of the roll of media R mounted on the mount 64 on the basis of the amount of displacement.

Then, the control unit 68 adjusts the height of the mount 64 by telescoping the telescopic mechanisms 63 such that the height Hm of the roll of media R matches the height Hr of the rotational members 231. Note that the control unit 68 may be configured to change the height of the mount 64 after a predetermined period of time (e.g. 10 seconds) has passed since mounting the roll of media R on the mount 64, or may be configured to change the height of the mount 64 after obtaining permission from the user.

Next, a description is given of the actions of the printing apparatus 10 and the conveying apparatus 60.

The printing apparatus 10 of the exemplary embodiment prints on the medium M unwound from the roll of media R. Thus, as the medium is unwound, the printing apparatus 10 prints on the unwound portion. As such, when the remaining amount of the roll of media R is small or when replacing the roll of media R with a different roll of media R, work is performed to remove the roll of media R from the supply unit 20. Then, work is performed to install another roll of media R.

During the work of installing the roll of media R, the user first mounts the roll of media R on the conveying apparatus 60. However, the roll of media R mounted on the conveying apparatus 60 may be a roll of media R that has a small outer diameter or may be a roll of media R that has a large outer diameter. That is, the outer diameter of the roll of media R mounted on the mount 64 is not constant and, as such, there is a possibility that the height Hm of the roll of media R while mounted on the mount 64 may not match the height Hr of the holding members 220. In other words, the outer diameter of the roll of media R may vary from one roll to the next. As a result, the height Hm of the roll of media R mounted on the mount 64 can vary and may not match the height Hr.

Here, according to the exemplary embodiment, with the conveying apparatus 60, the height of the mount 64 is adjusted when the height Hm of the roll of media R mounted on the mount 64 does not match the height Hr of the holding members 220.

That is, when the height Hm of the roll of media R mounted on the mount 64 is greater than the height Hr of the holding members 220 as illustrated in FIG. 5, the telescopic mechanisms 63 are contracted exactly the amount of difference in height as indicated by the solid arrow. On the other hand, when the height Hm of the roll of media R mounted on the mount 64 is less than the height Hr of the holding members 220 as illustrated in FIG. 6, the telescopic mechanisms 63 are extended exactly the amount of difference in height as indicated by the solid arrow. Thus, the height of the mount 64 is adjusted such that the rotational axis Am of the roll of media R mounted on the mount 64 matches or is at the same height as the rotational axis Ar of the rotational members 231 of the holding members 220 in the vertical direction Z.

Figure 7:
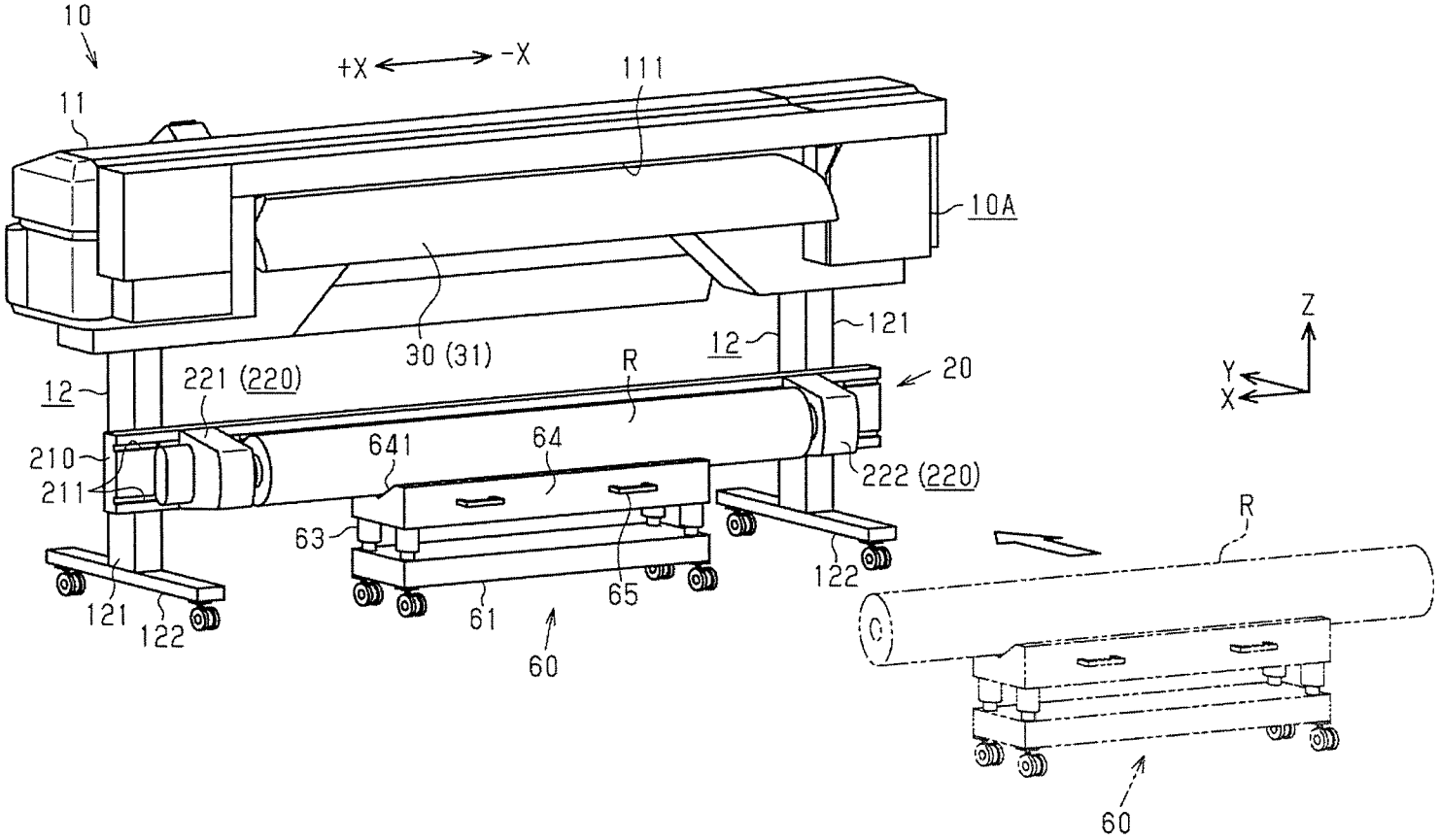
FIG. 7 is a perspective view illustrating a situation in which a roll of media conveyed by the conveying apparatus is mounted on the printing apparatus.

Then, as illustrated in FIG. 7, the user of the printing apparatus 10 conveys the conveying apparatus 60, for which the height of the mount 64 has been adjusted, to the printing apparatus 10. Here, in the exemplary embodiment, the supply unit 20 is supported so as to protrude backward from the legs 12. The guide member 210 that supports the holding members 220 such that the holding members 220 are capable of movement in the width direction X is disposed closer to the legs 12 side (the front side) than the holding members 220 in the supply unit 20. As such, space vertically below the pair of holding members 220 and vertically below the area between the pair of holding members 220 is formed, and the conveying apparatus 60 can be moved into this space. In other words, the arrangement of the holding members 220 and the guide member 210 allow the space needed to load the roll of media R to be empty so that the roll of media R can be easily installed.

Then, the conveying apparatus 60 is moved to the space described above so that the rotational axis Am of the roll of media R mounted on the mount 64 matches the rotational axis Ar of the rotational members 231 of the holding members 220 in the horizontal direction Y. Thus, the rotational axis Am of the roll of media R mounted on the mount 64 matches the rotational axis Ar of the rotational members 231 of the holding members 220 of the supply unit 20 in the horizontal direction Y and the vertical direction Z.

Next, the rotational member 231 of the first holding member 221 is engaged with the end portion on the first end +X side of the roll of media R by moving the first holding member 221 toward the second end −X side on the guide member 210, and the rotational member 231 of the second holding member 222 is engaged with the end portion on the second end −X side of the roll of media R by moving the second holding member 222 toward the first end +X side on the guide member 210. Thus, according to the printing apparatus 10 of the exemplary embodiment, the roll of media R mounted once on the conveying apparatus 60 can be installed on the printing apparatus 10 without the need to re-mount the roll of media R with respect to the printing apparatus 10. Rather, the conveying apparatus 60 is moved such that the roll is positioned between the first and second holding members. The first and second holding members are then moved such that they engage with the ends of the roll.

This is easily achieved because the axis of rotation of the roll is positioned to match the rotational axis of the first and second holding members.

Note that after causing the holding members 220 to hold or engage with the roll of media R, the medium M unwound from the roll of media R is set on the transport path, and a state in which printing can be started is achieved. Additionally, before starting the printing, it is preferable that the mount 64 is lowered or that the conveying apparatus 60 is moved away from the printing apparatus 10 or away from the installed roll of media R. This is to prevent the conveying apparatus 60 from obstructing the rotation of the roll of media R in the supply unit 20. This may simply require the conveying apparatus to lower or contact the adjustment member.

According to the exemplary embodiment described above, the following advantageous effects can be obtained.

(1) According to the exemplary embodiment, the guide member 210, which supports the holding members 220 such that the holding members 220 are capable of movement in the width direction X, is disposed at a position horizontally closer to the main body unit 10A than the holding members 220. In other words, the guide member 210, which supports the holding members 220 such that the holding members 220 are capable of movement in the width direction X, is not disposed in the space below the pair of holding members 220 and is not disposed in the area between the pair of holding members 220. As such, the conveying apparatus 60 on which the roll of media R is mounted can be moved such that the roll of media R is positioned in the area between the pair of holding members 220, while preventing interference between the guide member 210 and the conveying apparatus 60. Thus, the guide member 210 is positioned such that the guide member 210 does not interfere with the installation of the roll of media R.

Accordingly, the conveying apparatus 60 on which the roll of media R is mounted can be moved such that the roll of media R is positioned in the area between the pair of holding members 220. Thereafter, the holding members 220 can be caused to hold the roll of media R without repositioning the roll of media R. Thus, the burden placed on the user when installing the roll of media R on the printing apparatus 10 can be reduced by an amount corresponding to the eliminated temporarily mounting of the roll of media R on the printing apparatus 10. In other words, embodiments of the invention do not require the user to temporarily mount the roll of media R on the printing apparatus 10 prior to finishing the installation of the roll of media R.

(2) The introduction port 111 through which the medium M is introduced into the printing apparatus and the holding members 220 that hold the roll of media R are both provided on the back side of (behind) the main body unit 10A. As such, the path on which the medium M is guided from the holding members 220 to the introduction port 111 is prevented from becoming complicated.

(3) In the conveying apparatus 60 that conveys the roll of media R, the position in the vertical direction Z of the mount 64 on which the roll of media R is mounted is adjustable (e.g., by the controller and/or by user input and/or in response to detection results). As such, the height Hm of the roll of media R can easily be adjusted to the height Hr of the holding members 220. Accordingly, the burden placed on the user when installing the roll of media R on the printing apparatus 10 can be reduced.

(4) If the mount 64 of the conveying apparatus 60 is longer in the width direction X than the smallest roll of media Rm, the holding members 220 may interfere with the mount 64 when moving the holding members 220 inward in the width direction X in order to cause the holding members 220 of the printing apparatus 10 to hold the smallest roll of media Rm. Consequently, there is a risk that it will not be possible to move the holding members 220 to positions at which the roll of media R can be held.

Here, according to the exemplary embodiment, the mount 64 of the conveying apparatus 60 is shorter in the width direction X than the smallest roll of media Rm. As such, interference of the holding members 220 with the mount 64 can be prevented when moving the holding members 220 inward in the width direction X in order to cause the holding members 220 of the printing apparatus 10 to hold the smallest roll of media Rm. That is, regardless of the length in the width direction X of the roll of media R, it is easier to cause the holding members 220 to hold the roll of media R conveyed by the conveying apparatus 60. More specifically, because the width of the of the mount 64 is less than the smallest roll of media R that can be accommodated by the printing apparatus, the mount 64 does not interfere with the holding members 220 during installation of the roll of media R. The size of the smallest roll may vary among different printing apparatuses.

The exemplary embodiment described above may be modified as follows.

The mount 64 of the conveying apparatus 60 may be longer in the width direction X than the smallest roll of media Rm.

The conveying apparatus 60 may be configured such that the height of the mount 64 is manually adjusted by the user. Additionally, in cases where the outer diameter of the roll of media R conveyed by the conveying apparatus 60 is always the same, the conveying apparatus 60 may have a configuration in which the height of the mount 64 is not adjustable.

The supply unit 20 may be provided such that the supply unit 20 protrudes vertically downward from the housing 11, or may be provided such that the supply unit protrudes vertically downward from a frame provided facing backward from the first leg portion 121. In this case, the guide member 210 will be disposed at a position above the holding members 220 in the vertical direction Z. With this configuration as well, the advantageous effect (1) recited for the exemplary embodiment described above can be obtained because the guide member 210 is not disposed in the space vertically below the pair of holding members 220 and the area between the pair of holding members 220.

The supply unit 20 may be provided such that the supply unit 20 protrudes in a direction between vertically downward and backward from the main body unit 10A, that is, in a direction that proceeds vertically downward while proceeding backward (e.g., at an angle relative to one or more of the X, Y, and Z directions.

A winding unit may be provided on which the medium M, on which printing has been performed, is wound. In this case, the winding unit may be provided with a configuration corresponding to the supply unit 20. In one example, the winding unit may protrude forward from the legs 12. As a result of this configuration, when removing the roll of media R formed by winding the medium M, on which printing has been performed, from the winding unit, the roll of media R can be mounted on the mount 64 of the conveying apparatus 60 and conveyed as-is. The height of the mount can be adjusted if necessary for the height of the winding unit. Additionally, the burden placed on the user when installing a core member, on which the medium M on which printing has been performed is wound, on the winding unit can be reduced.

In cases where the roll of media R held by the holding members 220 is configured to be rotatable due to the transporting of the medium M by the transport unit 40, the first holding member 221 need not include the drive unit 233. In this case, the transport motor 43 corresponds to an example of "the drive unit". Alternatively, the first holding member 221 and the second holding member 222 may both include the drive unit 233.

The sliding members 232 of the holding members 220 and the sliding grooves 211 of the guide member 210 may have any configuration provided that the holding members 220 are capable of movement in the width direction X on the guide member 210. For example, a configuration is possible in which a rack is formed on the guide member 210, pinions meshing with the rack are provided on the holding members 220, and the holding members 220 are moved in the width direction X by rotating the pinions.

In cases where the remaining amount of the roll of media R mounted on the mount 64 is small and the displacement of the displacement member 66 is great, the conveying apparatus 60 (the control unit 68) may alert the user that the roll of media R mounted on the mount 64 is slight or small without changing the height of the mount 64. In this case, a display unit or the like for displaying the alert may be provided on the mount 64.

The conveying apparatus 60 (the control unit 68) may change the height of the mount 64 after the conveying apparatus 60 has been moved to the space vertically under the pair of holding members 220 and the area between the pair of holding members 220.

Here, in cases where the control unit 68 of the conveying apparatus 60 can acquire the height Hr of the holding members 220 by communicating with the printing apparatus 10, reading information recorded in the printing apparatus 10 or in a memory of the printing apparatus, or the like, the control unit 68 may change the height of the mount 64 on the basis of this height Hr. According to this configuration, the height of the mount 64 on which the roll of media R is mounted can be appropriately changed, even in cases where rolls of media R are conveyed to a plurality of printing apparatuses 10 having different heights Hr. The same conveying apparatus, for example, can carry different rolls of media R to different printing apparatuses and adjust the height of the mount 64 for each printing apparatus and for each roll.

In addition to a sheet, the medium M may be fiber, leather, plastic, wood, or ceramic.

The discharge unit 53 may be a so-called line head in which a nozzle row is formed having a length greater than or equal to the length of the medium M, and which is fixedly disposed on the printing apparatus 10.

In the exemplary embodiment, the recording material used in the printing may be a fluid other than ink (including, for example, liquids, liquid materials obtained by dispersing or mixing particles of a functional material in a liquid, fluid materials like a gel, and solids that can flow and be discharged as a fluid). For example, a configuration is possible in which recording is performed by discharging a liquid material that includes material such as electrode material, color material (pixel material), or the like used in the manufacture of liquid crystal displays, electroluminescence (EL) displays, surface emitting displays, and the like in a dispersed or dissolved form.

In the exemplary embodiment, the printing apparatus 10 is not limited to a printer that records by discharging ink. Examples thereof include non-impact printers such as laser printers, LED printers, thermal transfer printers (including sublimation type printers); and impact printers such as dot matrix printers and the like.

Japanese application 2016-102170 filed May 23, 2016 is incorporated by reference in its entirety.

What is claimed is:

1. A printing apparatus comprising:

a main body unit that includes a printing unit configured to print on a medium and legs supporting the printing unit;

a pair of holding members configured to hold both ends, in an axial direction, of a roll of media at a position vertically above a floor surface on which the main body unit is placed, the roll of media being formed by winding the medium;

a drive unit configured to rotate the roll of media held by the holding members;

a guide member connected to the main body unit and, when the axial direction of the roll of media held by the holding members is a width direction of the guide member, configured to support the holding members movably in the width direction, wherein the guide member is disposed at a position horizontally closer to the main body unit than the holding members; and a conveying apparatus including:

a mount on which the roll of media is mounted;

a control unit;

a displacement member configured to be displaced by the roll of media when the roll of media is mounted on the mount; and an adjustment member configured to adjust a vertical position of the mount;

the conveying apparatus being configured to convey the roll of media while the roll of media is mounted on the mount, wherein the adjustment member comprises a plurality of telescopic members that are disposed at corners of a rear side of the mount, wherein the control unit is configured to control the adjustment member based on an amount of displacement of the displacement member when the roll of media is mounted on the mount.

2. The printing apparatus according to claim 1, wherein:

the main body unit includes an introduction member on a back side the main body unit, the introduction member being configured to guide the medium to the printing unit; and the holding members are disposed on the main body unit via the guide member, wherein the holding members protrude backwards from the main body unit, vertically below the introduction member.

3. The printing apparatus according to claim 2, wherein the mount of the conveying apparatus is configured to be shorter in the width direction than the roll of media that is placed on the mount.

4. The printing apparatus according to claim 1, wherein the mount of the conveying apparatus is configured to be shorter in the width direction than the roll of media that is placed on the mount.

5. A conveying apparatus comprising:

a mount on which a roll of media is mounted;

a control unit;

a displacement member configured to be displaced by the roll of media when the roll of media is mounted on the mount; and an adjustment member configured to adjust a vertical position of the mount, wherein the adjustment member comprises a plurality of telescopic members that are disposed at corners of a rear side of the mount;

wherein:

the control unit is configured to control the adjustment member based on an amount of displacement of the displacement member when the roll of media is mounted on the mount the roll of media is formed by winding a medium; and the conveying apparatus is configured to convey the roll of media to a printing apparatus on which the roll of media is to be mounted and which is configured to print on the medium unwound from the roll of media.

* * * * *